United States Patent [19]

Ueda et al.

[11] 4,402,906

[45] Sep. 6, 1983

[54] METALLIC MATERIAL PROOF AGAINST ATTACHMENT OF MARINE ORGANISMS

[75] Inventors: Shoji Ueda; Takashi Daikoku; Masato Zama; Shintaro Matsuo; Masahiro Saito; Hidejiro Kinoshita, all of Nagasaki, Japan

[73] Assignee: Mitsubishi Jukogyo Kabushiki Kaisha, Tokyo, Japan

[21] Appl. No.: 272,526

[22] Filed: Jun. 11, 1981

[30] Foreign Application Priority Data

Jun. 16, 1980 [JP] Japan ..... 55-80117

[51] Int. Cl.[3] ..... C22C 9/05

[52] U.S. Cl. ..... 420/493; 420/470; 420/471; 420/473; 420/476; 420/485

[58] Field of Search ..... 75/161, 157.5, 159, 75/161; 148/32.5, 32; 420/480, 479, 470, 471, 473, 476, 493, 485

[56] References Cited

U.S. PATENT DOCUMENTS 3,323,913 6/1967 Bosman ..... 75/161

*Primary Examiner*—W. Stallard

*Attorney, Agent, or Firm*—Wenderoth, Lind & Ponack

[57] ABSTRACT

An alloy containing Mn in an amount of from 5 to 30 weight percent, at least one member selected from the group consisting of Sn of an amount of not more than 5 weight percent, Al of an amount of not more than 8.5 weight percent, Zn of an amount of not more than 7 weight percent, Fe of an amount of not more than 2.5 weight percent, and Ni of an amount of not more than 2.5 weight percent, and the balance to make up 100 weight percent of Cu plus normally entrained impurities produces a metallic material proof against the attachment thereto of marine organisms when the alloy fulfils a requirement that it should possess an α(face-centered cubic lattice) single-phase structure.

1 Claim, No Drawings

METALLIC MATERIAL PROOF AGAINST ATTACHMENT OF MARINE ORGANISMS

BACKGROUND OF THE INVENTION

1. Field of the Invention

This invention relates to a metallic material capable of preventing or curbing attachment thereto of marine organisms.

2. Description of the Prior Art

When ships are polluted by the attachment of marine organisms to the shells, particularly the underwater surfaces, of their hulls, their speeds are lowered and their fuel economies are degraded. By this reason, there has been an established practice of coating the surfaces of their hulls with pollution-proofing paints containing such pollution-proofing agents as copper suboxide and organic compounds of tin or using metallic materials such as copper, cupro-nickel (Cu-Ni alloy), zinc and silver which exhibit excellent resistance to the pollution.

These pollution-proofing paints and pollution-free metallic materials nevertheless have demerits of their own as shown below.

POLLUTION-PROOFING PAINTS (1) There are limits to the concentrations in which the pollution-proofing agents are tolerated in the pollution-proofing agents exude from the paints dwindle with elapse of time. There are limits also to the thicknesses to which the pollution-proofing paints can be applied to the shells. Thus, the pollution-proofing paints have a short effective service life. The ships using such paints, therefore, are required to have their hulls periodically cleaned of attached marine organisms or repainted.

(2) Some pollution-proofing agents contain organic compounds of tin which are harmful to the human system and to fish and shellfish.

(3) The applied coats of pollution-proofing paints possess inferior strength and weak adhesive power, sustain injuries readily and peel off easily.

POLLUTION-FREE METALLIC MATERIALS (1) The pollution-free metallic materials, when used in shells of hulls, do not always exhibit satisfactory resistance to the pollution.

(2) Copper, zinc, and silver are deficient in strength and in resistance to the action of seawater and, particularly when the ships are sailing in waters of turbulent flow, they offer very poor resistance to corrosion.

(3) Cupro-nickel and silver are costly.

For the purpose of overcoming the various drawbacks mentioned above, this invention is aimed at providing a pollution-free metallic material which (1) exhibits outstanding and lasting resistance to the pollution, (2) possesses high strength and toughness enough for the material to be used as structual members in shells of ships' hulls and marine structures for the purpose of precluding the drawbacks proper to paints such as inferior adhesive power and susceptibility to infliction of injuries and to exfoliation, (3) neither does harm to the human system and fish and shellfish nor causes seawater pollution, (4) enjoys low cost, (5) excels in adaptability to casting, hot and cold working and welding operations, and (6) offers excellent resistance to the action of seawater.

SUMMARY OF THE INVENTION

To accomplish the object described above according to this invention, there is provided a metallic material which is formed of an alloy containing Mn in an amount of from 5 to 30 weight percent, at least one member selected from the group consisting of Sn of an amount of not more than 5 weight percent, Al of an amount of not more than 8.5 weight percent, Zn of an amount of not more than 7 weight percent, Fe of an amount of not more than 2.5 weight percent and Ni of an amount of not more than 2.5 weight percent, and the balance to make up 100 weight percent of Cu plus normally entrained impurities and which is characterized by metallographically possessing an $\alpha$ (face-centered cubic lattice) single-phase structure.

DETAILED DESCRIPTION OF THE INVENTION

For the metallic material of this invention defined above, Mn is the most important element for the sake of preventing of curbing the attachment of marine organisms. When the content of Mn is less than 5 weight percent, the pollution-proofing effect of Mn on the alloy is not sufficient. When the content of Mn exceeds 50 weight percent, the alloy is not easily given the $\alpha$ single-phase structure by the heat treatment. Particularly where the contents of Sn, Al, and Zn are increased, it becomes all the more difficult for the alloy to be given the $\alpha$ single-phase structure by the heat treatment if the content of Mn exceeds 30 weight percent. It should be noted that in the present invention, the metallic material exhibits outstanding resistance to the pollution when the alloy possesses the $\alpha$ single-phase structure but that this resistance of the metallic material is notably degraded when the alloy suffers coexistence of a $\beta$ (body-centered cubic lattice phase or an $\alpha$-Mn (cubic lattice) phase.

In addition to Mn, at least one member selected from the group consisting of Sn, Al, Zn, Fe and Ni is contained. Sn is an element effective in preventing or curbing the attachment of marine organisms. When the content of Sn exceeds 5 weight percent, however, there ensue eduction of a $\beta$ phase and degradation of the pollution-proofing effect. Al is an element highly effective in enhancing the alloy's casting property, strength and resistance to water. When the content of Al exceeds 8.5 weight percent, however, the alloy suffers occurrence of heterogeneous phases such as $\beta$ phase and $Cu_3Mn_2Al$, incurs serious loss of the resistance to the pollution and, moreover, renders the hot and cold working and welding operations very difficult. Zn is effective in enhancing the alloy's strength and improving its casting property. When the content of Zn exceeds 7 weight percent, however, the alloy suffers occurrence of a $\beta$ phase and incurs loss of the resistance to the pollution and, furthermore, loss of the toughness. Fe is effective in enhancing the alloy's resistance to corrosion and strength. When the content of Fe exceeds 2.5 weight percent, however, the alloy suffers eduction of extraneous compounds such as Fe and Fe-Al, incurs degradation of the resistance to corrosion and serious loss of the pollution-proofing effect and also the hot and cold workability. Ni is also effective in conferring upon the alloy enhanced resistance to corrosion and improved strength. When the content of Ni exceeds 2.5 weight percent, however, the alloy suffers eduction of Ni-Al compound and others in the form of a κ phase and loss of the pollution-proofing effect.

Because these alloy elements have unique attributes to offer and further because Cu is used as the matrix, the alloy exhibits high resistance to the action of seawater and enjoys low cost as compared with cupro-nickel and silver. Particularly to the enhancement of the alloy's resistance to corrosion and to the pollution, the metallographic limitation of the alloy to the α single-phase structure contributes a great deal. The alloy components contemplated by this invention for addition to the alloy do not include harmful organic compounds of tin. The concentrations of the ions of Cu, Mn and other alloy components which are allowed to exude from the alloy are far lower than their respective official tolerances. Thus, the metallic material of this invention does absolutely no harm to the human system and to fish and shellfish.

When components of the alloy fall within the respective ranges defined above, the metallic material of the present invention spontaneously acquires the α single-phase structure without undergoing any additional treatment after the casting. Even if the metallic material fails to acquire this specific structure after the casting, it is given this structure as by a procedure of heating at temperatures of 550° to 850° C. and subsequent sudden cooling.

Although a metallic material containing alloy components in amounts deviating from the ranges defined for the metallic material of this invention can be given an α single-phase structure by a special heat treatment, its metallographic structure is affected by the subsequent thermal hysteresis. Thus, the metallic material finds it extremely difficult to retain the α single-phase stably.

As described above, to the metallic material of this invention, the definition of the ranges for the amounts of varying alloy components and the acquisition by the alloy of the α single-phase structure are indispensable. Studies made concerning the condition of the attachment of marine organisms and the relation between this attachment of marine organisms and the metallographic structure of alloys have led to a discovery that in order for the metallic material to manifest its outstanding resistance to the pollution, satisfaction of the requirement that the alloy components should be contained in amounts falling within the respective specified ranges is hardly sufficient but simultaneous satisfaction of this requirement and the other requirement that the alloy should acquire the α single-phase structure is indispensable.

Consequently, the metallic material of the present invention enjoys various advantages as follows:

(1) Because of the α single-phase structure of the alloy, it offers ample resistance to the pollution and to corrosion.

(2) Because of the use of Cu as the matrix of alloy, the metallic material defies the pollution and resists the action of seawater and enjoys low cost compared with silver, for example.

(3) The reinforcement due to the incorporation of Al, Zn, Fe, etc. enables the metallic material to be used as structural members possessing strength equalling the strength of cupro-nickel. Use of the metallic material results in solution of the various problems proper to paints, such as limited pollution-proofing effect, weak adhesive power, and susceptibility to infliction of injuries and exfoliation.

(4) Owing to the incorporation of a proper amount of Al, the alloy excels in adaptability to casting, hot and cold working and welding operations.

(5) Since the alloy components do not include harmful substances such as organic compounds of tin, the metallic material is harmless to the human system and to fish and shellfish.

The metallic material of the present invention, therefore, is highly suitable for structural members such as portions of shells of ships' hulls embracing and neighboring draft marks.

Now, the metallic material of this invention will be described specifically below with reference to working examples.

EXAMPLE

The following table shows pollution-resisting properties and mechanical properties exhibited by metallic materials conforming to the requirements of this invention and comparative metallic materials not conforming to the requirements.

Of the comparative metallic materials indicated, the copper of Symbol C and the cupro-nickel of Symbol CN (alloy of 90 percent of Cu and 10 percent of nickel) were the materials purchased in the market. The other comparative metallic materials and the metallic materials of the present invention were invariably produced by melting the respective alloys in a 50-kg high-frequency melting furnace, cast in metal molds, forged hot and, after the forging, heated at 600° C. for four hours and then allowed to cool off in air unless otherwise specified.

As test pieces, sheets measuring 90 mm in length, 70 mm in width and 3 mm in thickness were prepared. For the pollution-resisting effect, these sheets were tested by being suspended at a depth of 1 m under the surface of seawater from a raft floating in a certain harbor for three months in the winter (February) through the spring (April) seasons.

Generally, all metallic materials used for the purpose of precluding attachment of marine organisms, such as the metallic material of this invention, are naturally expected to fulfil the following requirements:

(1) Resistance to the pollution.
(2) Resistance to the action of seawater.
(3) Sufficient strength.
(4) Sufficient toughness.
(5) Adaptability to hot and cold working.
(6) Weldability.
(7) Economy.

While the requirements (1), (2), and (7) are admissable as essential, the metallic material used in structural members or machine parts becomes useless when it fails to fulfil any one of the other requirements (3), (4), (5), and (6).

In due consideration of this fact, the comparative metallic materials and the metallic materials conforming to the requirements of this invention will be compared below.

Comparative material F-1, despite ample strength and malleability, were deficient in resistance to the pollution due to attachment of marine organisms and occurrence of corrosion. In addition, it possessed poor workability because of excess incorporation of Fe.

Comparative material F-2 were deficient in strength, resistance to the pollution, resistance to corrosion and particularly in malleability. Besides, it possessed poor workability because of excess addition of Fe.

Comparative materials F-3, F-4, despite excellent strength, were deficient in malleability, resistance to the pollution and resistance to corrosion. Owing to excessive incorporation of Al, they were deficient in workability and weldability, the very properties indispensable to structural members.

Comparative material AlBC, though satisfactory both in strength and malleability, were deficient in resistance to the pollution. Further, owing to excessive incorporation of Fe and Al, it showed poor workability and weldability.

Comparative material C was deficient in resistance to the pollution and exhibited very poor strength and weldability.

Comparative material CN, though satisfactory in strength and malleability, was deficient in resistance to the pollution. It suffered high cost among other demerits.

By contrast, the metallic materials conforming to the requirements of this invention possessed strength comparable with the strength of cupro-nickel, excelled in resistance to the pollution and satisfactory in resistance to corrosion, workability, weldability and economy.

A review of the metallographic structures and the conditions of the attachment of marine organisms as indicated in the table clearly reveals that there exists a definite correlation between the $\alpha$ single-phase structure and the resistance to the pollution.

The metallic material of the present invention can be used in (1) plates for shells of ships' hulls, (2) oil drilling facilities, (3) oceanic storage tanks, (4) oceanic hotels, (5) piers, buoys, floating beacons, and lighthouses, (6) seawater inlet pipes and screens, (7) ingredients for pollution-proofing paints, (8) seawater pumps and motors and underwater pumps and valves, (9) heat-exchangers using seawater, (10) chains, ropes, clock facilities and materials in general destined to exposure to seawater, and (11) various devices for marine nurseries, outboard gears for ships, fishing gears, iron rails, etc.

| | Symbol | Chemical composition (weight percent) Mn | Sn | Al | Zn | Fe | Ni | Cu | Metallographic structure (600° C. × 4 hrs, air cooling) |
|---|---|---|---|---|---|---|---|---|---|
| Metal materials conforming to requirements of this invention | AF-1 | 9.71 | 0.10 | 3.05 | 1.25 | 0.51 | 0.60 | Balance | $\alpha$ single-phase |
| | AF-2 | 28.16 | — | 0.98 | 0.78 | 0.22 | 0.34 | Balance | $\alpha$ single-phase |
| | AF-3 | 19.68 | 0.47 | 1.25 | — | 0.10 | 0.41 | Balance | $\alpha$ single-phase |
| | AF-4 | 6.11 | 1.30 | 6.60 | 1.60 | 0.72 | 1.65 | Balance | $\alpha$ single-phase |
| | AF-5 | 9.53 | 0.23 | 3.08 | — | 1.40 | 0.11 | Balance | $\alpha$ single-phase |
| | AF-6 | 9.80 | — | — | — | 0.43 | 0.53 | Balance | $\alpha$ single-phase |
| | AF-7 | 9.92 | — | 2.02 | — | 1.92 | — | Balance | $\alpha$ single-phase |
| | AF-8 | 9.53 | — | 3.08 | 6.02 | 0.50 | 0.57 | Balance | $\alpha$ single-phase |
| | AF-9 | 8.43 | 4.60 | — | — | — | — | Balance | $\alpha$ single-phase |
| | AF-10 | 12.31 | 0.30 | 0.50 | — | 0.53 | 0.62 | Balance | $\alpha$ single-phase |
| Comparative metal materials | F-1 | 9.08 | — | 6.25 | 4.06 | 4.37 | 1.07 | Balance | $\alpha + \kappa$ |
| | F-2 | 15.98 | 5.48 | 7.50 | 5.50 | 2.78 | 2.93 | Balance | $\alpha + \beta + \kappa$ |
| | F-3 | 23.46 | 1.62 | 11.07 | — | 1.06 | 4.34 | Balance | $\alpha + \kappa + Cu_3Mn_2Al$ (Gradually cooled) |
| | F-4 | 12.22 | 7.82 | 8.80 | 0.02 | 0.60 | 5.28 | Balance | $\alpha + \kappa - \beta$ |
| | AlBC | 1.73 | — | 8.32 | — | 2.91 | 1.26 | Balance | $\alpha + \kappa$ |
| | C | — | — | — | — | — | — | >99.9 | $\alpha$ single-phase |
| | CN | 0.76 | — | — | — | 1.64 | 9.65 | Balance | $\alpha$ single-phase |

| | Symbol | Condition of attachment of marine organisms (after three months' immersion) | Mechanical properties: Tensile strength (kg/mm$^2$) | Elongation (%) | Remarks |
|---|---|---|---|---|---|
| Metal materials conforming to requirements of this invention | AF-1 | No attachment, green corrosion product | 45.2 | 40.4 | |
| | AF-2 | No attachment, greenish brown corrosion product | 40.7 | 42.6 | |
| | AF-3 | No attachment, green corrosion product with slight brown tint | 43.5 | 36.8 | |
| | AF-4 | No attachment, light green corrosion product | 55.6 | 39.2 | |
| | AF-5 | No attachment, green corrosion product | 48.1 | 39.0 | |
| | AF-6 | No attachment, green corrosion product | 42.0 | 50.4 | |
| | AF-7 | No attachment, green corrosion product | 40.1 | 48.2 | |
| | AF-8 | No attachment, green corrosion product | 43.3 | 37.0 | |
| | AF-9 | No attachment, green corrosion product | 33.9 | 28.6 | |
| | AF-10 | No attachment, green corrosion product | 39.2 | 46.4 | |
| Comparative metal materials | F-1 | Attachment, reddish brown corrosion product | 43.8 | 39.2 | |
| | F-2 | Attachment, black corrosion product | 34.6 | 15.8 | Cast product |
| | F-3 | Attachment, black corrosion product | 70.8 | 28.0 | Cast product |
| | F-4 | Attachment, black and | 50.3 | 32.4 | Cast |

-continued

| | | | | |
|---|---|---|---|---|
| | brown corrosion products | | | product |
| AlBC | Attachment of blackish green slime | 59.8 | 41.0 | Commercial product |
| C | Attachment of blackish green slime | 24.4 | 48.2 | Commercial product |
| CN | Attachment of blackish green slime | 35.5 | 39.0 | Commercial product |

What is claimed is:

1. A metallic alloy containing Mn in an amount of from 5 to 12.31 weight percent, at least one member selected from the group consisting of Sn in an amount of not more than 5 weight percent, Al in an amount of not more than 8.5 weight percent, Zn in an amount of not more than 7 weight percent, Fe in an amount of not more than 2.5 weight percent, and Ni in an amount of not more than 2.5 weight percent, and the balance to make up 100 weight percent of Cu plus normally entrained impurities and which is characterized by metallographically possessing an α-(face-centered cubic lattice) single-phase structure.

* * * * *